US008707838B2

(12) United States Patent
Supe-Dienes

(10) Patent No.: US 8,707,838 B2
(45) Date of Patent: Apr. 29, 2014

(54) CUTTING ARRANGEMENT HAVING A TIP-TO-TIP BLADE ARRANGEMENT

(75) Inventor: Rudolf Supe-Dienes, Overalth (DE)

(73) Assignee: Dienes Corporation—USA, Spencer, MA (US)

( * ) Notice: Subject to any disclaimer, the term of this patent is extended or adjusted under 35 U.S.C. 154(b) by 52 days.

(21) Appl. No.: 12/871,713

(22) Filed: Aug. 30, 2010

(65) Prior Publication Data

US 2012/0132046 A1 May 31, 2012

Related U.S. Application Data

(63) Continuation-in-part of application No. 11/841,252, filed on Aug. 20, 2007, now abandoned.

(30) Foreign Application Priority Data

Aug. 19, 2006 (DE) ..... 20 2006 012 820 U

(51) Int. Cl.
*B26D 5/20* (2006.01)

(52) U.S. Cl.
USPC ..... 83/76.6; 83/76.7; 83/76.8; 83/500; 83/503

(58) Field of Classification Search
USPC ..... 83/500–503, 76.7, 76.8, 76.9, 76.6
See application file for complete search history.

(56) References Cited

U.S. PATENT DOCUMENTS

| | | | | | |
|---|---|---|---|---|---|
| 1,422,901 | A * | 7/1922 | Orvill | 83/430 |
| 4,274,319 | A * | 6/1981 | Frye et al. | 83/430 |
| 4,380,945 | A * | 4/1983 | Guild et al. | 83/482 |
| 4,467,431 | A * | 8/1984 | Gardner et al. | 700/157 |
| 4,566,471 | A * | 1/1986 | Kumasako et al. | 131/317 |
| 4,785,699 | A * | 11/1988 | Oblinger et al. | 83/425 |
| 5,165,314 | A * | 11/1992 | Paulson et al. | 83/29 |
| 5,911,807 | A * | 6/1999 | Brooks et al. | 83/262 |
| 6,010,131 | A * | 1/2000 | Myers | 273/148 R |
| 2004/0221699 | A1 * | 11/2004 | Adachi et al. | 83/174.1 |
| 2008/0041203 | A1 * | 2/2008 | Regterschot et al. | 83/13 |

* cited by examiner

*Primary Examiner* — Omar Flores Sanchez
(74) *Attorney, Agent, or Firm* — Jennifer S. Stachniak; Robert W. Becker

(57) ABSTRACT

A cutting arrangement for longitudinally cutting material includes two blades disposed across from one another and which cooperate during cutting. Each blade is embodied as a circular blade having a sharp cutting edge and supported by an adjusting or placement mechanism. During the cutting process, the circular blades are positioned by the adjusting or placement mechanisms so that the cutting edges overlap one another to form an overlap zone, the center of which coincides with the middle of the material that is to be cut. An adaptive control assembly includes individual drive motors for driving each blade and enables constant side load force control for each blade, such that side load pressures are adjustable in response to changes in web sped, web tension, and blade condition in real time. Automatic blade diameter sensors calculate the zero point of the cut, determine the appropriate blade speed and automatically set the overlap.

15 Claims, 7 Drawing Sheets

CUTTING ARRANGEMENT HAVING A TIP-TO-TIP BLADE ARRANGEMENT

The present application is a continuation-in-part of U.S. application Ser. No. 11/841,252 Aug. 20, 2007 now abandoned. The instant application should be granted the priority date of Aug. 19, 2006, the filing date of the corresponding German patent application 20 2006 012 820.4.

BACKGROUND OF THE INVENTION

The present invention relates to a cutting arrangement for the longitudinal cutting or division of material and includes two blades that are disposed across from one another and that during the cutting process cooperate with one another.

If material having a great thickness, or in particular a stack of a plurality of superimposed lengths of material, which similarly have a corresponding overall material thickness, is to be cut or divided by a cutting arrangement in a cut, there results, with a cutting arrangement that is comprised, for example, of an upper blade embodied as a circular blade and a lower blade embodied as a grooved counter blade, the problem that the cutting blade must penetrate appropriately deeply into the material that is to be cut, so that the outwardly disposed area of material is cut or pressed apart when the blade passes through not by the cutting edge, but rather by the blade face that is adjacent to the edge. In this area, a correspondingly poor cut quality is regularly registered.

SUMMARY OF THE INVENTION

It is therefore an object of the present invention to provide a cutting arrangement having the aforementioned general features with which it is also possible to cut or divide great material thicknesses of a material that is to be cut or divided with a defined cut quality.

The basic concept of the invention is a cutting arrangement where each of the blades is embodied as a circular blade that has a sharp cutting edge and is supported by an adjusting or placement device, wherein during the cutting process the circular blades are positioned by means of the adjusting or placement mechanisms in such a way that the cutting edges overlap one another to form an overlap zone and the center of the overlap zone coincides with the middle of the material that is to be cut or divided. The invention has the advantage that two circular blades in a tip-to-tip arrangement are used as upper blade and lower blade, with the blades thus uniformly cutting into the material that is to be cut or divided from both sides. Since the two circular blades overlap to form an overlap zone, a complete severing of the material is ensured. To the extent that with such a blade arrangement the ideal cutting point is disposed in the middle of the overlap zone, by means of the positioning of the two circular blades the present invention sees to it that the middle of its overlap zone coincides with the middle of the material that is to be cut or divided.

Pursuant to one embodiment of the invention, the material is composed of a length of material having a corresponding material thickness, and the circular blades are positioned in such a way that the center of their overlap zone is disposed in the middle of the material thickness of the length of material.

Pursuant to another embodiment of the invention, the material that is to be cut or divided is composed of a stack of individual lengths of material, and the circular blades are positioned in such a way that the center of their overlap zone is disposed in the middle of the overall material thickness of the stack of lengths of material.

To be able to undertake a precise positioning of the two circular blades that cut into the material, respective sensors for detecting the overlap zone can be disposed on the adjustment or placement mechanisms for the circular blades and can be coupled with control devices for the respective adjustment movement of the circular blades.

To the extent that on the one hand a fixation of the material that is to be fed must be effected, and on the other hand also a reference line for the setting of the position in particular of the lower blade of the blade arrangement must be present, it is proposed pursuant to an embodiment of the invention that the cutting arrangement include a fixation device for the feeding of the material that is to be cut or divided to the cutting blades, and that the lower blade extend beyond the upper edge of the fixation device by the amount that is to be set in conformity to the thickness of the material that is to be cut or divided and to the overlap zone of the cutting blades. In this connection, pursuant to specific embodiments of the invention, the fixation device can be embodied as a fixation or guide table that supports the material that is to be cut or divided, or also as an upstream fixation roller over which the material that is to be cut or divided is guided.

The control devices for the adjustment movements of the circular blades can be connected to an input unit for the thickness of the material that is to be cut or divided; alternatively, a device for detecting or determining the thickness of the material that is to be cut or divided can be disposed upstream of the circular blades and can be connected with the control devices for the adjustment movements of the circular blades. In this connection, the device for determining or detecting the thickness of material that is to be cut or divided is expediently disposed on the fixation device for the feeding of the material that is to be cut or divided.

Since the cutting arrangement of the present invention relates to a constantly moving web of material that will impart varying loads on the knives when slitting, the present invention also embodies an adaptive control technology with the following features: individual drive motors for each of the knife blades; and a constant side load force control for each knife blade that allows for knife blade side force load monitoring, which adjusts side load pressures to respond to changes in web speed, web tension, and blade condition for real time control. The adaptive control technology used with the cutting arrangement further provides for automatic knife diameter sensing that calculates the zero point of the cut, determines the appropriate knife speed, and automatically sets the overlap. The system therefore is particularly well-suited for multi-layer applications.

BRIEF DESCRIPTION OF THE DRAWINGS

The drawing shows specific embodiments of the invention, which will be described subsequently, and in which drawings.

DETAILED DESCRIPTION OF THE PREFERRED EMBODIMENTS

Figure 1:
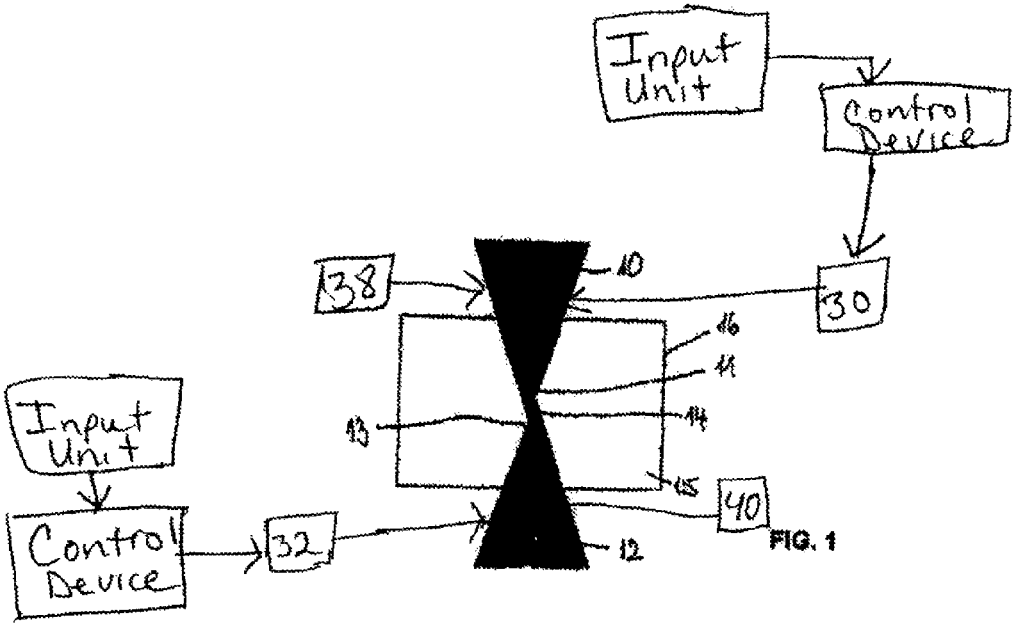
FIG. 1. is a schematic illustration showing a cutting arrangement, comprised of two cutting edges, or the cutting or dividing of a length of material.

As can be seen from FIG. 1, the blade or cutting arrangement, which is provided for cutting a band or length of material 15 having a great material thickness 16, is comprised of an upper blade 10 and a lower blade 12, whereby each of the upper blade 10 and lower blade 12 has a sharp blade or cutting edge 11 or 13 respectively. In this connection, upper blade 10 and lower blade 12 are disposed or positioned relative to one another in such a way that an overlap zone 14 of the two cutting edges 11, 13 results. To achieve the best possible cutting result, upper blade 10 and lower blade 12 are positioned in such a way that the center of the overlap zone 14 is disposed in the middle of the material thickness of the length of material 15.

Figure 2:
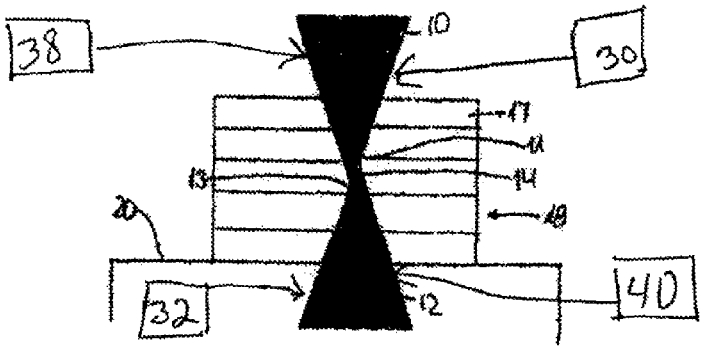
FIG. 2 shows the subject matter of FIG. 1 for the cutting or dividing of a stack comprised of a plurality of super imposed lengths of material.

In the embodiment illustrated in FIG. 2, the material that is to be cut or divided by the upper blade 10 and the lower blade 12 is comprised of a stack 18 of individual bands or lengths of material 17 that are disposed one above the other and that together also form a correspondingly great material thickness. The stack 18 is disposed on a fixation or guide table 20 and by means thereof is fed to the blade arrangement 10, 12. The lower blade 12 extends through the fixation table 20 and, by an amount that is to be set in conformity to the respective material thickness of the material that is to be cut and to the required overlap zone, extends beyond the surface of the fixation table 20 that forms a zero or reference line for the positioning of the lower blade 12. In conformity with the embodiment described in conjunction with FIG. 1, here also the upper blade 10 and lower blade 12 are to be positioned by means of the adjusting or placing mechanisms 30, 32 that support them in such a way that the center of the overlap zone 14 of the cutting edges 11, 13 is disposed in the middle of the overall material thickness of the stack 18.

FIGS. 3 through 6 illustrate the adaptive control assembly utilized in the cutting arrangement according to the present invention shown in FIGS. 1 and 2. As noted previously, since the cutting arrangement of the present invention relates to a constantly moving web of material that will impart varying loads on the knives when slitting, the present invention also embodies an adaptive control technology with the following features: individual drive motors for each of the knife blades; and a constant side load force control for each knife blade that allows for knife blade side force load monitoring, which adjusts side load pressures to respond to changes in web speed, web tension, and blade condition for real time control. The adaptive control technology used with the cutting arrangement further provides for automatic knife diameter sensing that calculates the zero point of the cut, determines the appropriate knife speed, and automatically sets the overlap. The system therefore is particularly well-suited for multilayer applications.

Figure 3:
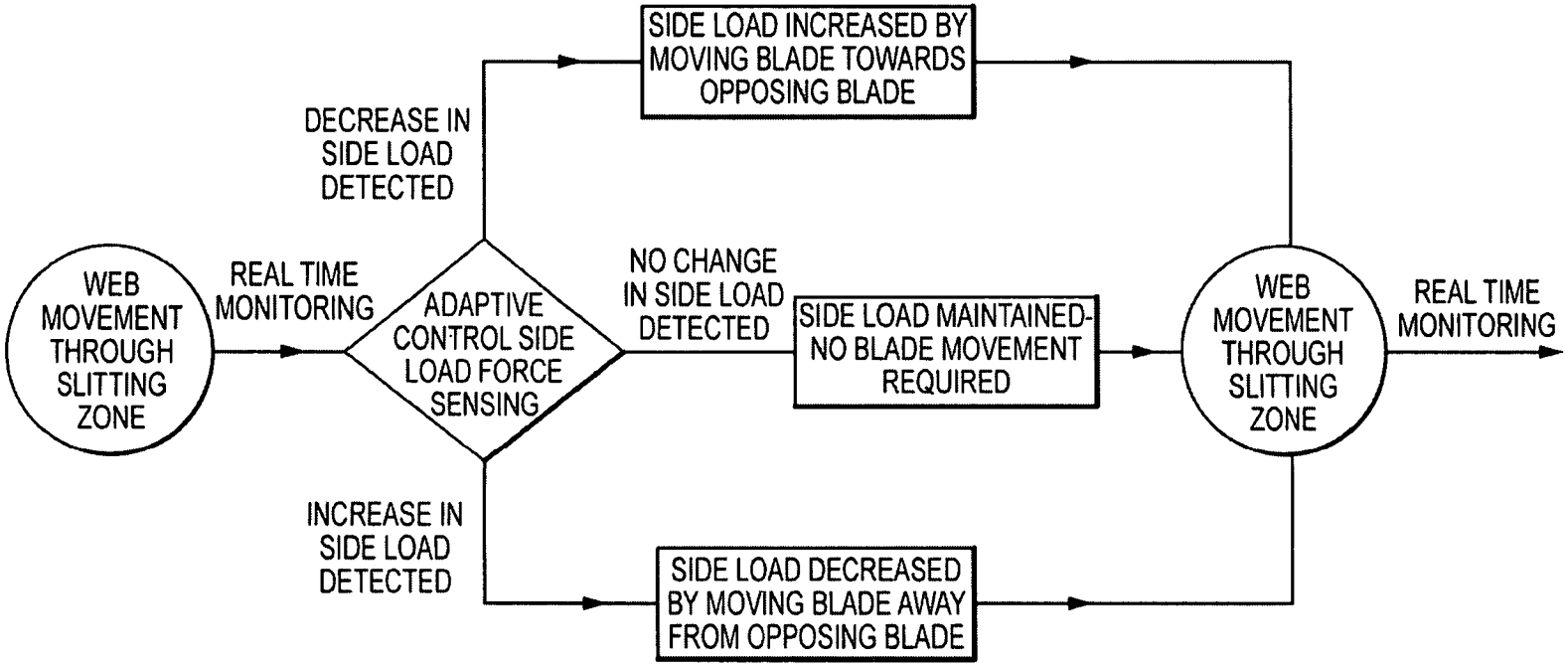
FIG. 3 shows basic functionality of the adaptive control sensing function and conditional movements.
Figure 3A:
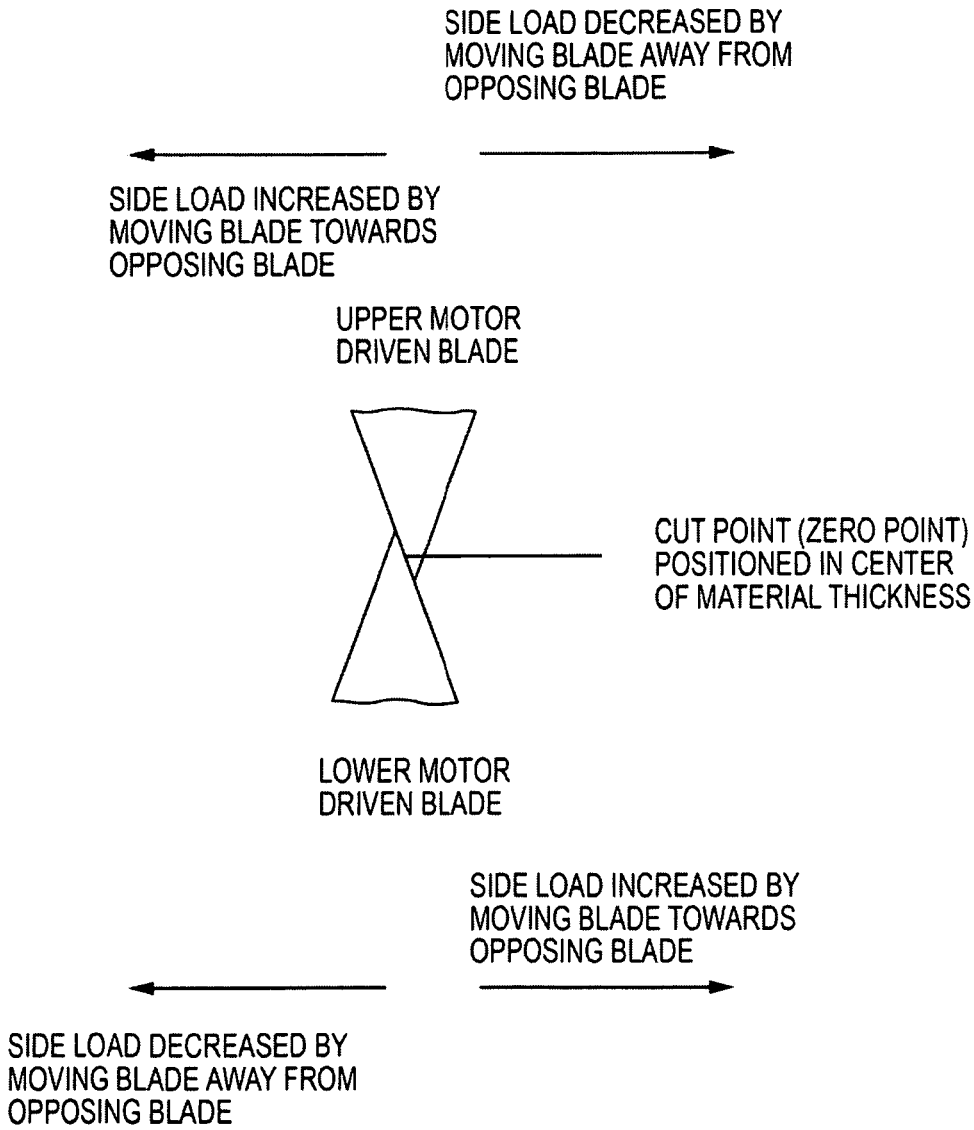
FIG. 3*a* shows a graphical representation of the two blades in opposite to each other along with conditional movements directions.

FIG. 3 illustrates the basic functionality of the adaptive control sensing function and conditional movements of the arrangement relative to the web movement through the slitting zone. FIG. 3*a* shows a graphical representation of the two blades in opposition to each other along with conditional movement directions. FIGS. 3 and 3*a* further show that shear knife constant side load force technology that is used with an adaptive, real time side load force sensing. This feature allows for adjustments of the side load forces in response to changes in web speed, web thickness, web tension and blade condition.

Figure 4:
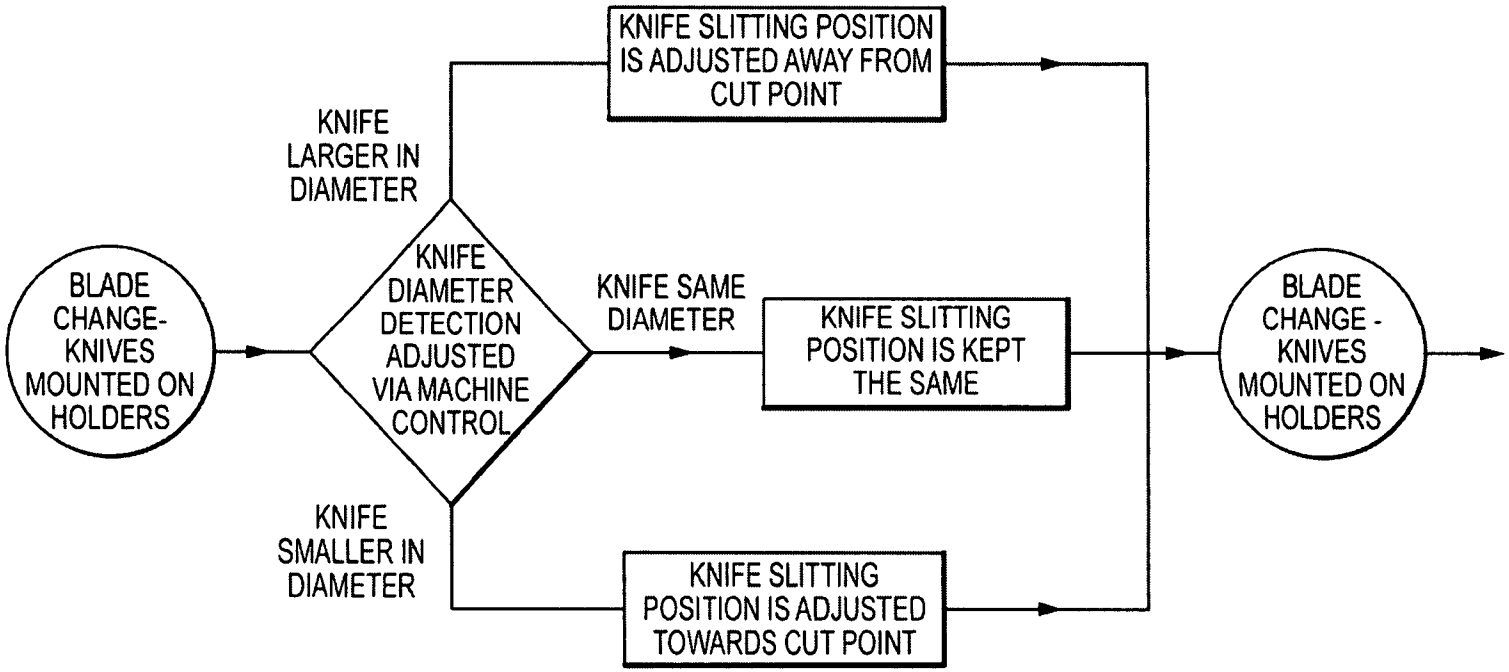
FIG. 4 shows basic functionality of the blade diameter detection function and conditional movements.

FIG. 4 illustrates the basic functionality of the knife blade diameter detection function and conditional movements. The blade diameter sensing that is initiated through the machine control calculates the resultant movement required to position the sensed knife diameter at the cut point (zero point) in order to maintain the point at the center of a given web thickness. Without knife blade diameter sensing and positioning, the upper and lower knife holder must be manually repositioned to maintain a relative cut point if a newly assembled blade diameter is different than the diameter of a blade that was removed.

A web thickness detection sensor can also be connected into the machine control and in conjunction with the upper and lower blade diameter sensors 38, 40 (see, e.g., FIGS. 1 and 2), the upper and lower blades are automatically positioned to achieve the needed cut point at the center of the web thickness.

Figure 5:
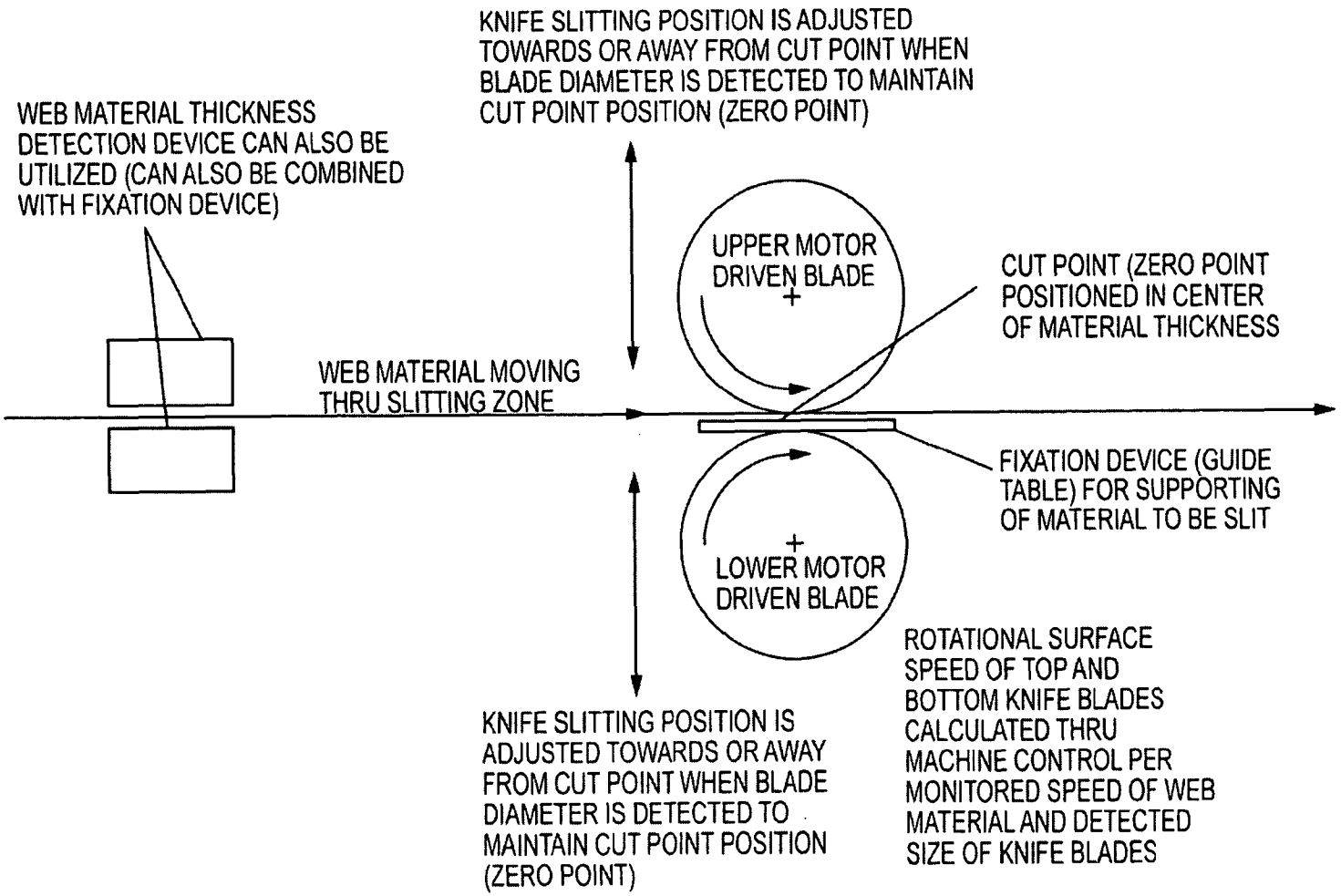
FIG. 5 shows a graphical representation of the upper and lower knives positioned with the cut point between them at the center of the web thickness being processed.
Figure 5A:
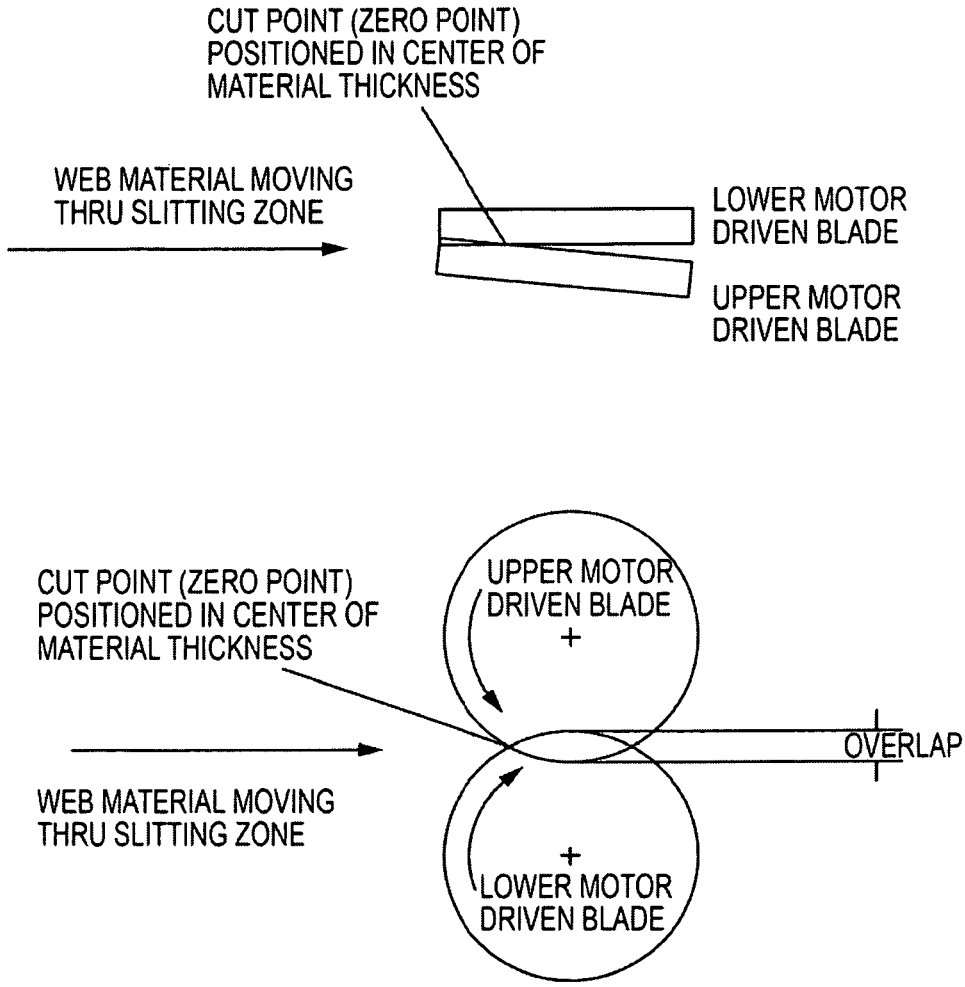
FIG. 5*a* shows a representation of the upper and lower knife relations with a resultant cut point.

FIG. 5 is a schematic representation of the upper blade 10 and lower blade 12 positioned with the cut point between them at the center of the web thickness being process. In addition, the conditional movement direction for the upper and lower knife holders that are required when the blade diameter detection device sense the actual blade diameters being utilized are shown. FIG. 5*a* illustrates the upper blade 10 and lower blade 12 relations with a resultant cut point.

Figure 6:
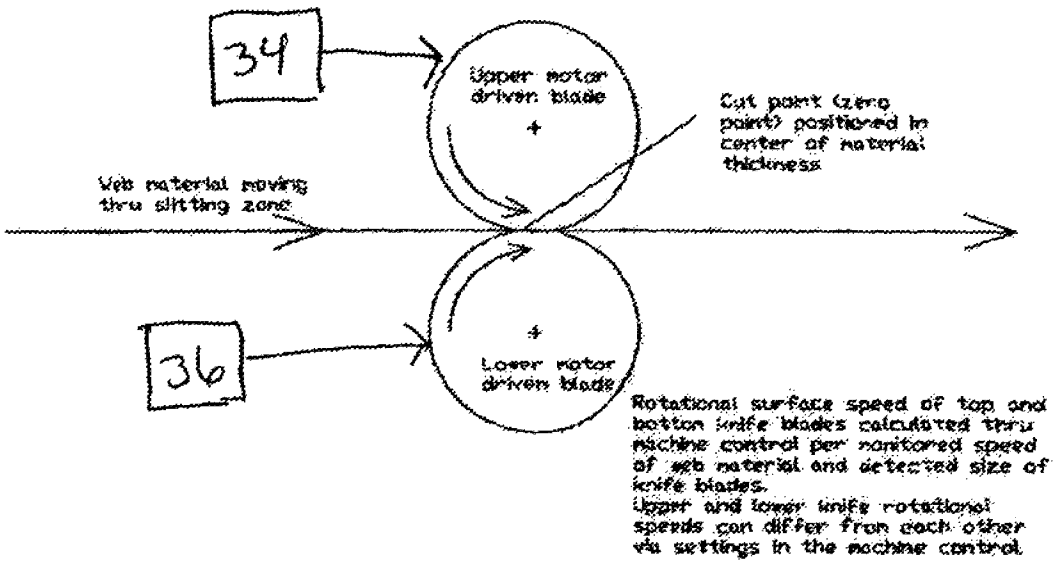
FIG. 6 shows a depiction of the web material moving through the cut point and how the rotational speed of the upper and lower driven blades do not have to match one another.

FIG. 6 illustrates the web material moving through the cut point. As shown in FIG. 6, the speeds of the driven upper blade 10 and lower blade 12 do not have to match one another. Indeed, certain materials that might comprise the web may require differential speeds.

Individual drive motors 34, 36 for each of the upper and lower blades 10, 12 provide for rotational surface speed matching as well as differential speed capabilities. The wide variety of web materials, compositions, web tensions, and web speeds require the maximum in flexibility in order to adequately control the efficiency of the slitting action at the cut point in order to maximize slit edge quality.

The invention further provides for a method for longitudinally cutting or dividing material utilizing the steps shown in FIGS. 3 through 6.

The features of the subject matter of the these documents disclosed in the preceding specification, the claims and the drawing can be important individually as well as in any desired combination with one another for realizing the various embodiments of the invention.

The specification incorporates by reference the disclosure of German 20 2006 012 820.4 filed Aug. 19, 2007.

The present invention is, of course, in no way restricted to the specific disclosure of the specification and drawings, but also encompasses any modifications within the scope of the appended claims.

We claim:

1. A method for longitudinally cutting or dividing material, comprising the following steps:

providing a cutting assembly comprising two blades that are disposed across from one another and that during a cutting process cooperate with one another, wherein each of said blades is embodied as a circular blade having a sharp cutting edge and supported by an adjusting or placement mechanism;

cutting said material, wherein during said cutting said circular blades are positioned by means of said adjusting or placement mechanisms in such a way that said cutting edges overlap one another to form an overlap zone and a center of said overlap zone coincides with a middle of the material that is to be cut or divided; and providing an adaptive control assembly configured for compensating load fluctuations, said adaptive control assembly comprising separate, individual drive motors for driving each of the two blades; means for constant side load force control; and blade diameter sensors for sensing automatically a respective diameter of said blades, matching rotational surface speeds of said blade; and setting differential speeds for said blades via said individual drive motors.

2. A method for longitudinally cutting or dividing material, comprising the following steps:

providing a cutting assembly comprising two blades that are disposed across from one another and that during a cutting process cooperate with one another, wherein each of said blades is embodied as a circular blade having a sharp cutting edge and supported by an adjusting or placement mechanism;

cutting said material, wherein during said cutting said circular blades are positioned by means of said adjusting or placement mechanisms in such a way that said cutting edges overlap one another to form an overlap zone and a center of said overlap zone coincides with a middle of the material that is to be cut or divided;

providing an adaptive control assembly configured for compensating load fluctuations, said adaptive control assembly comprising separate, individual drive motors for driving each of the two blades; means for constant side load force control; and blade diameter sensors for sensing automatically a respective diameter of said blades;

monitoring of a blade side force and adjusting in real time side load pressures in response to changes in web speed, web tension, and blade condition by said means for constant side load force control; and automatically calculating a zero point of a cut, automatically determining a blade speed for said blades that is suitable for said material being cut, and automatically setting the overlap zone by said blade diameter sensors.

3. A method for longitudinally cutting or dividing material, comprising the following steps:

providing a cutting assembly comprising two blades that are disposed across from one another and that during a cutting process cooperate with one another, wherein each of said blades is embodied as a circular blade having a sharp cutting edge and supported by an adjusting or placement mechanism;

cutting said material, wherein during said cutting said circular blades are positioned by means of said adjusting or placement mechanisms in such a way that said cutting edges overlap one another to form an overlap zone and a center of said overlap zone coincides with a middle of the material that is to be cut or divided;

providing an adaptive control assembly configured for compensating load fluctuations, said adaptive control assembly comprising separate, individual drive motors for driving each of the two blades; means for constant side load force control; and blade diameter sensors for sensing automatically a respective diameter of said blades; and automatically calculating a zero point of a cut, automatically determining a blade speed for said blades that is suitable for said material being cut, and automatically setting the overlap zone by said blade diameter sensors.

4. A cutting arrangement for longitudinally cutting or dividing material, comprising:

two blades that are disposed across from one another and that during a cutting process cooperate with one another, wherein each of said blades is embodied as a circular blade having a sharp cutting edge and supported by an adjusting or placement mechanism, wherein during a cutting process said circular blades are positioned by means of said adjusting or placement mechanisms in such a way that said cutting edges overlap one another to form an overlap zone and a center of said overlap zone coincides with a middle of the material that is to be cut or divided; and adaptive control assembly configured for compensating load fluctuations, said adaptive control assembly comprising separate, individual drive motors for driving each of the two blades; means for constant side load force control; and blade diameter sensors for sensing automatically a respective diameter of said blades, wherein said means for constant side load force control are configured for monitoring of a blade side force and to adjust in real time side load pressures in response to changes in web speed, web tension, and blade condition, and wherein the blade diameter sensors are configured to automatically calculate a zero point of a cut, to automatically determine a blade speed for said blades that is suitable for said material being cut, and to automatically set the overlap zone.

5. A cutting arrangement for longitudinally cutting or dividing material, comprising:

two blades that are disposed across from one another and that during a cutting process cooperate with one another, wherein each of said blades is embodied as a circular blade having a sharp cutting edge and supported by an adjusting or placement mechanism, wherein during a cutting process said circular blades are positioned by means of said adjusting or placement mechanisms in such a way that said cutting edges overlap one another to form an overlap zone and a center of said overlap zone coincides with a middle of the material that is to be cut or divided; and adaptive control assembly configured for compensating load fluctuations, said adaptive control assembly comprising separate, individual drive motors for driving each of the two blades; means for constant side load force control; and blade diameter sensors for sensing automatically a respective diameter of said blades, wherein the individual drive motors are adapted to enable rotational surface speed matching and differential speeds of said blades, and wherein the blade diameter sensors are configured to automatically calculate a zero point of a cut, to automatically determine a blade speed for said blades that is suitable for said material being cut, and to automatically set the overlap zone.

6. A cutting arrangement for longitudinally cutting or dividing material, comprising:

two blades that are disposed across from one another and that during a cutting process cooperate with one another, wherein each of said blades is embodied as a circular blade having a sharp cutting edge and supported by an adjusting or placement mechanism, wherein during a cutting process said circular blades are positioned by means of said adjusting or placement mechanisms in such a way that said cutting edges overlap one another to form an overlap zone and a center of said overlap zone coincides with a middle of the material that is to be cut or divided; and adaptive control assembly configured for compensating load fluctuations, said adaptive control assembly comprising separate, individual drive motors for driving each of the two blades; means for constant side load force control; and blade diameter sensors for sensing automatically a respective diameter of said blades, wherein the blade diameter sensors are configured to automatically calculate a zero point of a cut, to automatically determine a blade speed for said blades that is suitable for said material being cut, and to automatically set the overlap zone.

7. The cutting arrangement according to claim 4, wherein the material is composed of a length of material having a given material thickness, and wherein said circular blades are positioned in such a way that the center of said overlap zone is disposed in the middle of said material thickness of said length of material.

8. The cutting arrangement according to claim 4, wherein the material that is to be cut or divided is composed of a stack of individual lengths of material, and wherein said circular blades are positioned in such a way that the center of said overlap zone is disposed in the middle of the overall material thickness of said stack of lengths of material.

9. The cutting arrangement according to claim 4, wherein respective sensors for detecting or determining said overlap zone are disposed on said adjusting or placement mechanisms for said circular blades and are coupled with control devices for respective adjustment movements of said circular blades.

10. The cutting arrangement according to claim 4, further comprising a fixation device that is adapted to feed the material that is to be cut or divided to said circular blades, wherein a lower one of said blades extends beyond an upper edge of said fixation device by an amount that is to be set in conformity with a material thickness of the material that is to be cut or divided and to said overlap zone of said circular blades.

11. The cutting arrangement according to claim 10, wherein said fixation device is embodied as a fixation or guide table that is adapted to support the material that is to be cut or divided.

12. The cutting arrangement according to claim 10, wherein said fixation device is embodied as a fixation roller over which the material that is to be cut or divided is adapted to be guided.

13. The cutting arrangement according to claim 9, wherein said control devices for the adjustment movements of said circular blades are connected to an input unit for the material thickness of the material that is to be cut or divided.

14. The cutting arrangement according to claim 4, further comprising a device for determining or detecting the material thickness of the material that is to be cut or divided, wherein said device is disposed upstream of said circular blades and is connected to control devices for adjustment movements of said circular blades.

15. The cutting arrangement according to claim 4, further comprising a fixation device for support or feeding of the material that is to be cut or divided to said circular blades and a device for determining or detecting the material thickness of the material that is to be cut or divided, wherein said device is disposed on said fixation device.

* * * * *